United States Patent [19]

Beck, Jr.

[11] Patent Number: 4,550,645

[45] Date of Patent: Nov. 5, 1985

[54] THIN VALVE PLATE FOR A HYDRAULIC UNIT

[75] Inventor: Richard Beck, Jr., Ames, Iowa

[73] Assignee: Sundstrand Corporation, Rockford, Ill.

[21] Appl. No.: 605,019

[22] Filed: Apr. 27, 1984

[51] Int. Cl.[4] ..... B23P 15/60; B21K 1/20; B21K 1/24

[52] U.S. Cl. ..... 91/499; 29/156.7 R; 29/156.4 R

[58] Field of Search ..... 29/156.4 R, 156.7 R, 29/157.1 E; 91/487, 499, 503–507

[56] References Cited

U.S. PATENT DOCUMENTS

| | | | |
|---|---|---|---|
| 2,069,651 | 2/1937 | Ferris | 91/504 |
| 2,272,771 | 2/1942 | Hawley, Jr. | 91/505 |
| 2,297,518 | 9/1942 | Wegerdt | 91/486 |
| 2,633,104 | 3/1953 | Lauck et al. | 91/505 |
| 2,708,879 | 5/1955 | Van Meter | 91/506 |
| 2,847,984 | 8/1958 | Gallant | 91/486 |
| 3,186,352 | 6/1965 | Anderson | 91/506 |
| 3,286,647 | 11/1966 | Lambeth | 91/487 |
| 3,416,312 | 12/1968 | Margolin | 91/506 |
| 3,709,107 | 1/1973 | Alger | 91/499 |
| 3,904,318 | 9/1975 | Born | 91/487 |
| 3,996,891 | 12/1976 | Gostomski | 91/499 |
| 4,300,273 | 11/1981 | Lockart | 29/156.4 R |
| 4,437,389 | 3/1984 | Kline | 91/499 |

FOREIGN PATENT DOCUMENTS

| | | | |
|---|---|---|---|
| 1939297 | 2/1971 | Fed. Rep. of Germany | 91/499 |
| 57-91391 | 6/1982 | Japan | 29/156.4 R |
| 57-171086 | 10/1982 | Japan | 91/499 |
| 1268203 | 3/1972 | United Kingdom | 91/499 |
| 848740 | 7/1981 | U.S.S.R. | 417/312 |

*Primary Examiner*—William L. Freeh

*Attorney, Agent, or Firm*—James A. Wanner; Ted E. Killingsworth; Harold A. Williamson

[57] ABSTRACT

A thin valve plate for use in an axial piston hydraulic unit wherein valve plate ports are provided with slot shaped extensions passing through the valve plate to provide limited initial fluid communication between cylinder block ports and valve plate ports and wherein the thickness of the valve plate is no greater than one half the width of the slots. Furthermore, such valve plate facilitates economical manufacture wherein the slots and valve plate ports can be stamped in a hardened steel disk.

24 Claims, 14 Drawing Figures

THIN VALVE PLATE FOR A HYDRAULIC UNIT

FIELD OF THE INVENTION

The present invention is directed to a thin valve plate utilized in a hydraulic pump or motor of the axial piston type wherein the valve plate is of a hard material and facilitates manufacture by permitting stamping of the valve plate to provide the valve plate porting.

BACKGROUND OF THE INVENTION

It is quite common in axial piston units to utilize a hardened steel valve plate secured to the housing of a hydraulic pump or motor of the axial piston type. The valve plate has a plurality of valve plate ports extending therethrough to provide fluid communication between the cylinder ports of a rotating cylinder block located adjacent the front face of the valve plate with hydraulic unit inlet and outlet ports located behind the valve plate. Such valve plates are relatively thick and quite often have grooves, sometimes referred to as "fishtails", extending opposite the cylinder block rotation or in a leading direction from the first valve plate opening which is connected to either the inlet or outlet port. Such construction is taught by Moon Jr. U.S. Pat. No. 3,585,901 issued June 22, 1971. The leading grooves are provided for the purpose of gradually increasing fluid communication between the cylinder ports and the respective inlet or outlet port of the hydraulic unit in a manner which decreases hydraulic shock so as to reduce both noise and cavitation. Such grooves are quite difficult and expensive to machine since they are quite small and the valve plate is of hardened steel. Furthermore, even with the complicated machining, consistent depth grooves were difficult to obtain. Prior grooves were traditionally obtained by milling or chemical etching and were generally 0.050 to 0.070 inch deep in order to obtain optimum hydraulic gradual flow increase. Furthermore the machining difficulty, optimum shaped cross sections of the grooves were impractical to obtain.

Furthermore, it is known in the prior art to have the leading groove formed by a notch milled completely through the complete depth of a relatively thick valve plate to form the fishtail. Again, typically, the valve plate was a quarter of an inch thick and thus the notch extending through the valve plate was also approximately a quarter of an inch thick. Such notch is too deep to allow gradual or an optimum increase in fluid flow and thus not extremely effective in reducing noise and cavitation damage. This is especially true since the depth of the notch is several times greater than the width of the notch.

When the fishtails are provided by the shallow grooves, the valve plate can not be reversed unless further machining is used to provide fishtail notches on the opposite side of the valve plate, thus doubling the machining necessary. While the second identified prior art valve plate having a notch extending therethrough is reversible, it is again pointed out that the notches are not effective due to their extreme depth.

SUMMARY OF THE INVENTION

The present invention is directed to a valve plate structure which is relatively thin and wherein both the valve plate ports and the fishtails extend completely through the valve plate but the fishtails have an optimum depth relative to fluid flow so as to provide a gradual increase in flow to reduce both noise and cavitation. Thus, typically, the improved valve plate is approximately 0.050 to 0.070 inch thick and thus has a thickness approximately equal to the depth of the optimum milled grooves in the above mentioned Moon patent.

It is the object of the present invention to provide such a thin valve plate wherein the valve plate ports and the valve plate fishtails are provided by stamping of a hardened steel plate and wherein the steel plate is relatively thin so as to permit such stamping operation.

It is a further object of the present invention to provide a thin valve plate which could be reversibly mounted within the hydraulic unit housing. In a hydraulic unit that is reversible in direction operation of the cylinder block, reversibility of the valve plate doubles the wear life of the valve plate. In a valve plate design for a unidirectional operation of the cylinder block, reversibility of the valve plate reverses the fluid porting and fishtail design so as to facilitate reverse operation of the hydraulic unit.

It is a further object of the present invention to provide a thin valve plate for a hydraulic unit wherein the fishtail can be economically formed by stamping wherein the thickness of the valve plate is no greater than one-half the effective width of the fishtail.

It is a further object of the present invention to provide a valve plate for a hydraulic unit comprising a housing having inlet and outlet ports therein, a cylinder block having cylinders therein and being rotatable relative to the housing with each of the cylinders having a cylinder port, the cylinder ports serially communicating with the inlet and outlet ports, pistons slidable in the cylinders and displacement setting means for reciprocating the pistons within the cylinders and valve means positioned between the cylinder block and the inlet and outlet ports of the housing to selectively provide fluid communication between the housing ports and the cylinders in the cylinder block as the cylinder block rotates, the valve means including; a valve plate secured against rotation relative to the housing, the valve plate having a plurality of valve plate ports radially positioned so as to serially communicate with the cylinder ports, at least one of the valve plate ports having means at the leading edge thereof for increasing communication between the approaching cylinder ports and the associated inlet or outlet port, the means to increase communication including a slot extending through the valve plate with the valve plate having a thickness equal to or less than half the maximum width of the slot, and a housing portion abutting the side of the valve plate opposite the cylinder block to form the bottom of the slot.

DESCRIPTION OF THE PREFERRED EMBODIMENT

Figure 1:
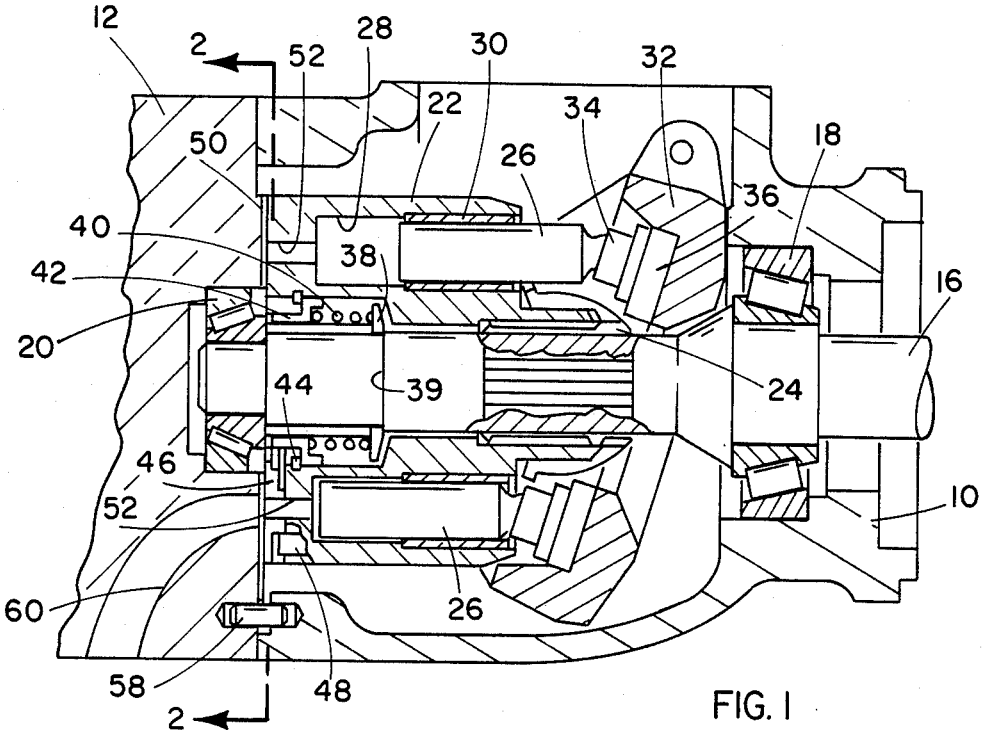
FIG. 1 is a sectional view of a hydraulic unit utilizing the thin valve plate of the present invention.

The thin valve plate of the present invention is particularly adaptable for use in an axial piston hydraulic unit such as seen in FIG. 1. The axial piston unit may be either a pump or motor and may be of either fixed displacement or variable displacement. The hydraulic unit has a housing generally indicated at 10 with an end cap 12 removably secured thereto such as by bolts 14 (seen in FIG. 2). A shaft 16 is secured against axial movement and rotatably mounted in the hydraulic unit by bearings 18 and 20. The shaft 16 in the case of a pump is a drive shaft and in the case of a motor is a driven shaft. A rotatable cylinder block 22 is mounted on the shaft 16 and drivingly connected thereto by splines 24. The cylinder block has a plurality of pistons 26 axially sliding within bores or cylinders 28. Each cylinder 28 may be provided with a bearing insert or bushing 30 within which the piston 26 reciprocates. Although only two pistons 26 are shown in FIG. 1, it is understood that the cylinder block 22 includes a plurality of annularly disposed cylinders, each having a piston reciprocating therein.

A cam or swashplate 32 is mounted toward the right end of the housing 10 and acts as a displacement setting means for controlling the reciprocating positions of the pistons 26 within the cylinders 28. The swashplate 32 may be fixed for a fixed displacement hydraulic unit or may be pivotably mounted within the housing 10 about an axis transverse and intersecting the axis of the drive shaft 16. In the variable displacement unit the swashplate 32 can pivot in either direction relative to a neutral central position (vertical in FIG. 1) for adjustment of the hydraulic unit displacement and the swashplate 32 may be adapted to be positioned by various input means. The outer ends of the pistons 26 are of a spherical configuration and are universally connected to bearing shoes or slippers 34 which are adapted to slide on the annular swashplate bearing member 36 as is common practice. In order to bias the cylinder block 22 toward the left in FIG. 1, an annular collar 38 abuts a shoulder 39 on the shaft 16 and provides a seat for a coil spring 40 surrounding the shaft. The coil spring 40 biases a second annular collar 42 which abuts a snap ring 44 secured to the cylinder block 22.

The cylinder block 22 may be provided with a bearing plate 46 secured to the cylinder block by a pin 48 such as seen in the lower portion of FIG. 1. The bearing plate 46 rotates with the cylinder block 22 and is in face to face rotating abutment due to the force of the coil spring 40 with a stationary valve plate 50 to be described in greater detail below. In less expensive constructions, no bearing plate is utilized such as seen in the top portion of FIG. 1. In such construction, the cylinder block 22 is generally formed from steel or iron and may be provided with a bronze coating which forms the left end face which abuts the valve plate 50. An axial passageway herein referred to as a cylinder port 52 connects each cylinder bore 28 with the left end face of the cylinder block 22. Where a bearing plate such as plate 46 is utilized, the cylinder port 52 also passes through the bearing plate 46 so as to provide a porting surface which rides against and rotates with respect to the valve plate 50.

The above description is directed to but one type of axial piston hydraulic unit which is representative of many well known hydraulic axial piston units. A more detailed description of the structure and operation of such hydraulic unit can be obtained from the above mentioned Moon Jr. U.S. Pat. No. 3,585,901.

Figure 2:
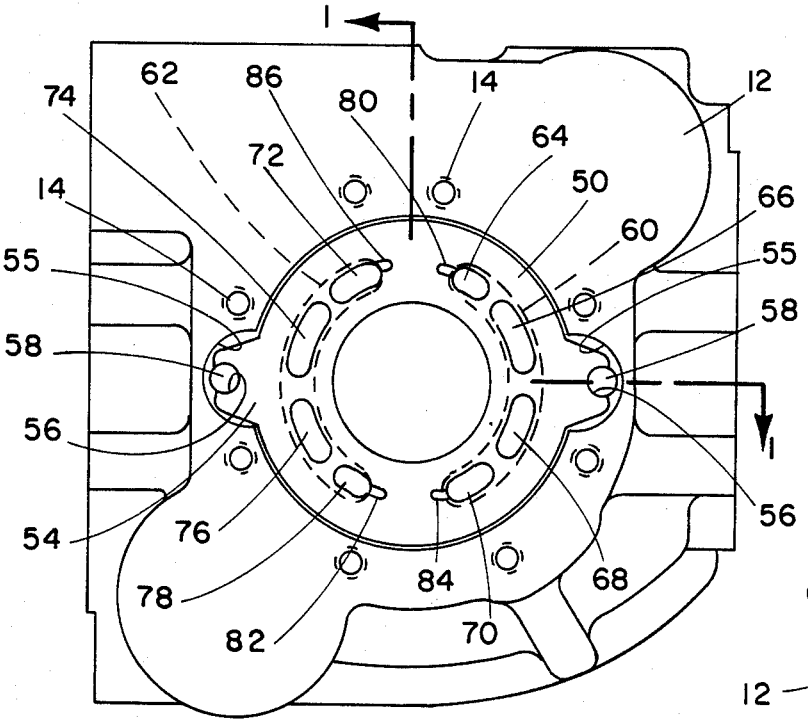
FIG. 2 is a sectional view taken along lines 2—2 of FIG. 1.
Figure 3:
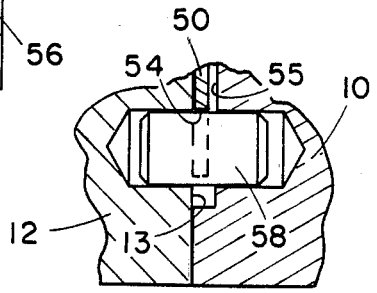
FIG. 3 is an enlarged fragmental view of a portion of FIG. 1 showing securing means for the thin valve plate.
Figure 4A:
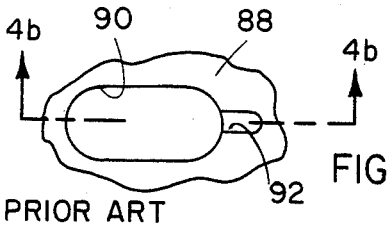
FIGS. 4*a* and 4*b* show a typical prior art valve plate wherein the fishtail does not extend through the valve plate.
Figure 4B:
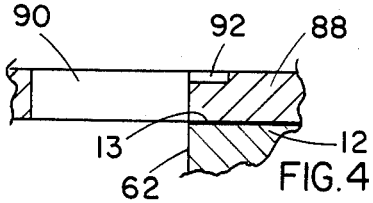

The valve plate 50 of the present invention is quite thin when compared to prior art. In order to prevent rotation of the valve plate 50, the valve plate 50 is provided with tabs 54 which extend radially outwardly from a circular periphery of the valve plate 50 as seen in FIG. 2, each tab 54 provided with a notch or opening 56 adapted to engage pins 58 which position the hydraulic unit housing 10 with respect to the end cap 12 as seen in FIGS. 1 and 3. The housing 10 is provided with shallow semi-circular recesses 55 as seen in FIGS. 2 and 3 which provide clearance for the valve plate tabs 54. With such construction, the flat valve plate 50 abuts an inner planar face 13 of the end cap 12 in a manner which reinforces and supports the thin valve plate 50.

The end cap 12 is provided with a pair of housing ports 60 and 62, one of which is seen in FIG. 1 and both of which are shown in dotted lines in FIG. 2, and which act as the inlet and outlet ports for the hydraulic unit. When the hydraulic unit is used as a motor, the inlet and outlet functions of the housing ports 60 and 62 can be reversed to provide reversible operation of the hydraulic motor. When the hydraulic unit functions as a pump and wherein the cylinder block 22 is unidirectional in rotation, one of the ports 60 or 62 will function as an inlet port while the other port will function as the outlet port dependent upon the position of the swashplate 32. If the pump cylinder block 22 is to be driven in both directions by shaft 16, the housing ports 60 and 62 will also reverse in the inlet and outlet functions dependent upon the direction of rotation of the cylinder block 22.

The valve plate 50 is biased against the inner face 13 of the end cap 12 by the leftward force of the spring 40 acting through the cylinder block 22. In such position, the valve plate 50 overlies the housing ports 60 and 62 as seen in FIG. 2. The valve plate 50 is provided with four valve plate ports 64, 66, 68 and 70 which directly overlie and are in fluid communication with the housing port 60. The valve plate 50 is also provided with four valve plate ports 72, 74, 76 and 78 which directly overlie and are in fluid communication with the housing port 62. Since the section line 1—1 of FIG. 2 extends vertically between the valve plate ports 64 and 66 and horizontally between valve plate ports 68 and 70, no valve plate ports are shown in FIG. 1. For clockwise rotation of the cylinder block 22, the valve plate ports 64 and 78 are the leading ports for the housing ports 60 and 62 respectively, while the valve plate ports 70 and 72 are the trailing ports. Thus the cylinder block 22 rotates, the cylinder ports 52 serially and progressively come into fluid communication with the housing ports 60 and 62 by first coming into fluid communication with the valve plate ports 64 and 78 respectively. The cylinder ports 52 leave the fluid communication with the housing ports 60 and 62 as they pass valve plate ports 70 and 72. For counterclockwise rotation of the cylinder block 22, the leading and trailing communication function reverses.

The leading edges of the valve plate ports 64 and 78 are provided with port extensions 80 and 82 respectively in the form of slots. These port extensions are sometimes referred to as fishtails and are used to reduce the hydraulic shock that would occur when the leading edge of a given cylinder port 52 first overlaps the leading edge of the valve plate port 64 or 78 when there is no fishtail. When the hydraulic unit is reversible such as a motor and thus fishtails or port extensions 84 and 86, shown in phantom lines in FIG. 2, are provided for valve plate ports 70 and 72. Dependent upon the direction of rotation of the cylinder block, either the fishtails 80 and 82 or the fishtails 84 and 86 are in the leading direction. The fishtails or slots 80 and 82 provide gradual initiation of fluid communication as a given cylinder port 52 approaches the leading ports 64 and 78. The gradual initiation of fluid communication reduces the hydraulic shock and thus can greatly reduce hydraulically induced noise and excessive wear that can be caused by fluid cavitation. Past practice indicates that the shape of the fishtail as well as the depth of the fishtail is quite critical as to its effectiveness in reducing noise and cavitation damage.

FIGS. 4*a*–5*b* teach prior art methods of forming fishtails in valve plates. In the valve plate 88 of FIGS. 4*a* and 4*b*, the valve plate port 90, which extends through the valve plate, has a fishtail 92 machined in only the surface of the valve plate 88. In practice, the valve plate 88 is approximately 0.25 inch thick while the depth of the fishtail 92 is between 0.050–0.070 inch. In order to provide an effective gradual increase in fluid communication, the fishtail 94 has an optimum design with a depth no greater than 50% of the width of the fishtail 92. Since the valve plate 88 is hardened steel, and since the fishtail is quite small, machining of the fishtail 92 is quite difficult and expensive. Also, such machining operation, such as electrochemical machining, does not consistently produce a constant depth of the fishtail 92.

Figure 5A:
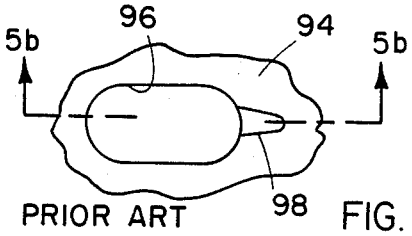
FIGS. 5*a* and 5*b* teach another prior art thick valve plate wherein the fishtail is provided by a notch extending through the valve plate.
Figure 5B:
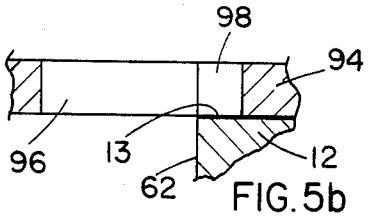

In the prior art configuration FIGS. 5*a* and 5*b*, the valve plate 94 also has a valve plate port 96 which extends through the complete thickness of the valve plate 94. However, in FIGS. 5*a* and 5*b*, the fishtail 98 also extends through the complete depth of the valve plate 94 which does facilitate forming of the fishtail 98. However, such prior art valve plate 94 is also of hardened steel and 0.25 inch deep and thus the ports 96 and 98 must be formed by a machining operation such as milling. The bottom of the fishtail 98 is defined by the end cap surface 13 which abuts the valve plate 94 including that area of the valve plate which forms the fishtail 98, but is relieved behind the valve plate port 96 due to the formation of the port 62. The fishtail 98 of FIGS. 5*a* and 5*b* however is not an optimum design due to the large depth of the fishtail 98 particularly when compared to the width of the fishtail. When a cylinder port 52 passes over the leading edge of the fishtail 98, due to the extreme depth thereof, there is considerable fluid flow into the fishtail 98 when compared to the flow permitted by the shallow fishtail 92 of FIGS. 4*a* and 4*b*. The deep fishtail 98 does not provide as gradual an increase in fluid communication as would an optimum design and thus greater noise and cavitation result.

Figure 6A:
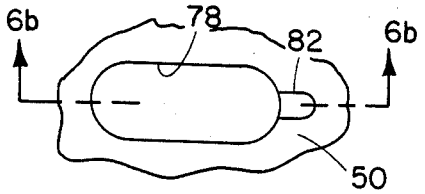
FIGS. 6*a* and 6*b* show the thin valve plate of the present invention with a fishtail notch provided for the valve plate port.
Figure 6B:
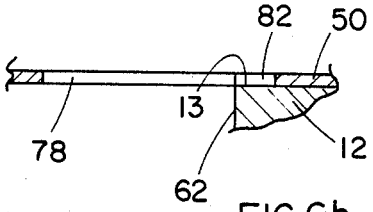

FIGS. 6*a* and 6*b* show the thin valve plate 50 of the present invention with one of the leading valve plate ports 78 and its adjacent fishtail 82. Again, the valve plate 78 as well as all other valve plate ports extend through the valve plate 50. Furthermore, the fishtail 82 also extends completely through the valve plate 50 but the valve plate 50 of the present invention is approximately one fifth the thickness of the prior art valve plates. The thin valve plate 50, even though the fishtail 82 extends completely through and the bottom of the fishtail 82 being provided by that portion of the end cap surface 13 which backs up the valve plate 50, has a fishtail whose depth is between 0.050 and 0.070 inch such as the optimum designed fishtail of FIGS. 4*a* and 4*b*. It is noted from FIG. 6*b* and FIG. 2 that the housing ports 60 and 62 extend to the leading edge of the valve plate ports 64 and 68 but do not extend behind the fishtails 80 and 82. Thus, even though the fishtails 80 and 82 extend completely through the thin valve plate 50, the depth of the fishtails is the optimum design which greatly reduces both noise and cavitation.

The thin hardened steel valve plate 50 also has another advantage relative to the ease of manufacture. A hardened steel plate can have openings stamped therethrough if the steel plate is relatively thin and if the thickness of the steel plate is less than the width of the openings to be formed. When the thickness of the steel plate approaches the width of the opening to be formed, stamping becomes somewhat difficult. However, with the valve plate 50 of the present design, the fishtail 82 has a width that is at least twice the thickness T of the valve plate 50 but yet the width of the fishtail can be quite small since the valve plate 50 is thin. The small cross section and depth from the optimum design of the fishtail which limits the initial flow to greater reduce the hydraulic shock. Stamping not only permits an inexpensive and quick stamping operation which is more accurate than the previous machining operations for shallow fishtails such as fishtail 92, but since the fishtail extends completely through the thin valve plate 50, there is always a consistent depth of the fishtail, that is the thickness T of the valve plate 50.

Figures 7A, 7B, 7C:
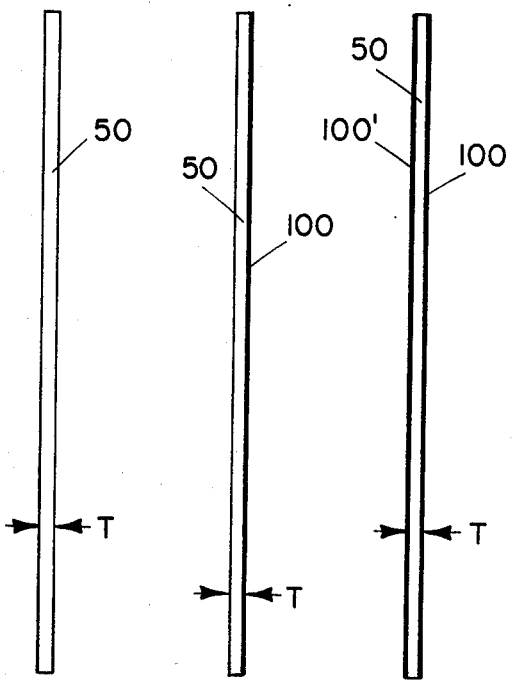
FIGS. 7*a*, 7*b* and 7*c* show side views of three different thin valve plates of the present invention.

The thin valve plate may be made of various materials as seen in FIGS. 7*a*, 7*b* and 7*c* but for a given hydraulic unit would always have the same thickness T. In FIG. 7*a* the valve plate 50 is of steel and thus both surfaces on the valve plate 50 are steel. In FIG. 7*b*, the valve plate 50 is made of steel stock which has a bronze facing 100 on one surface thereof, that is the surface which faces the cylinder block 22. In FIG. 7*c* the valve plate 50 is a trimetal material having a steel base with bronze facing 100 and 100' forming the surfaces thereon. In all three examples, the valve plate would have a common thickness T such as 0.050 inch.

If the cylinder block has the optional bronze bearing plate 46 secured thereto as mentioned above, the solid steel plate as shown in FIG. 7*a* would be utilized. This would also be true if the left hand end face of the cylinder block 22 is provided with a bronze coating even though no bearing plate 46 is used. However, when the cylinder block 22 end face has neither a bronze bearing plate 46 or a bronze end face, it is desirable to have the valve plate 50 provided with a bronze face 100 so that the abutting rotating surfaces form a steel/bronze interface. The bronze surface 100' on the opposite side of the bearing plate 50 as shown in FIG. 7*c* is used where it is desired to have a bearing plate which can be reversed in position relative to the housing in a manner which will be explained below. In all three plates 7*a*–7*c*, the plate is of commercially available steel stock whose hardness is dependent upon the designed pressures and expected life of the hydraulic unit. For high pressures or heavy duty units, the steel stock is of a nominal Rockwell C50 hardness and preferrably 0.050 inch thick, with and without the bronze facings.

Figure 8:
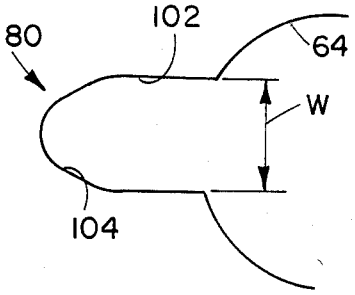
FIG. 8 shows an enlarged view of one form of fishtail notch as utilized in the valve plate of the present invention.
Figure 9:
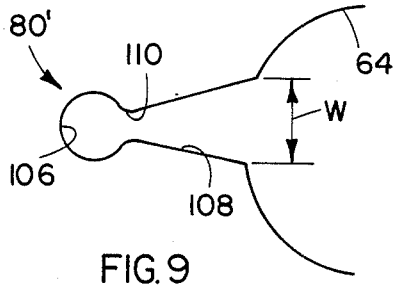
FIG. 9 shows a modified fishtail as may be utilized in the valve plate of the present invention.

FIGS. 8 and 9 show particular designs of the fishtails which may be readily stamped utilizing the thin valve plate of the present invention. While the fishtails can be the deep U shaped shown in FIGS. *4a* and *6a*, or the V shaped having a rounded bottom such as fishtail 98 in FIG. *5a*, FIGS. 8 and 9 teach two particularly desirable fishtail shapes. In FIG. 8 the fishtail 80 from the leading port 64 consists of a slot extending completely through the valve plate and having a portion 102 with a constant width W extending approximately two-thirds the length of the slot with the leading third of the slot being provided by a V shaped cross section 104 which increases in width from the rounded leading edge toward the valve plate port 64. In FIG. 9 the fishtail 80' is a generally keyhole-shaped cross section wherein the slot has a three-quarter circle cross section area 106 providing the leading portion of the fishtail with the tapered width portion 108 extending from the circular cross section area 106 and gradually increasing in width until it joins the valve plate port 64 with the mouth of the increasing portion 108 having a width W. For both the fishtail 80 and the fishtail 80' of FIGS. 8 and 9, the width W would be approximately 0.140 inch while the depth of the slot forming the fishtail be a consistent 0.050 inch, again the thickness T of the valve plate. The effective width of the keyhole-shaped fishtail 80' of FIG. 9 is the area of the fishtail divided by the length of the fishtail. Thus, the effective width of the slot is less than the maximum width W. A throat 110 is formed between two fishtail portions 106 and 108 which provides a venturi for the flow leading from the fishtail leading edge towards the port 64. This particular shape has been found extremely effective in reducing hydraulic flow induced noise but has been found to be extremely difficult to machine in prior art valve plates and is referred to for purposes of this specification as the keyhole-shaped cross section. With the thin plate of the present invention, such keyhole-shaped fishtail 80' is formed by stamping and thus easy and inexpensive to obtain. Due to the stamping operation, other shapes of fishtails are much easier to form than previously possible and all fishtail slots would have a constant depth, the depth being the thickness T of the thin valve plate. Since the valve plate openings are stamped, manufacturing is simple, quick and very low cost. Furthermore, the thin valve plate permits a slightly shorter hydraulic unit, and thus material usage for both the valve plate and the housing is reduced.

Another feature of the present valve plate is that the valve plate position can be reversed in the housing to provide either a new surface or to provide for reversibility of hydraulic unit operation. In a reversible motor, the valve plate 50 would be provided with four fishtails 80–86 as explained above and thus reversing the valve plate position relative to the housing provides the same symetrical shape and duplicates the running surface available. The same would be true for a reversible pump. Where a pump is unidirectional, that is the cylinder block rotates in one direction only, or where the pump (or motor) is operated with the majority of usage is in a single direction, only two fishtails 80 and 82 are utilized. Such hydraulic units are generally made for both "right hand" and "left hand" operation depending upon the usage intended. With the valve plate of the present invention, a single valve plate for both right and left hand usage can be manufactured with one position of the valve plate 50 within the housing providing for right hand operation and the reverse position of the valve plate within the housing providing for left hand operation. Such reversibility of the valve plate is possible since the fishtail slots extend completely through the valve plate and thus the plate 50 would be identical in shape and depth regardless of the orientation of the valve plate. Furthermore, since the valve plate 50 is thin, an optimum constant depth of the fishtails obtained wherein that depth is equal to or less than half the effective width of the fishtail regardless of valve plate orientation. Both the valve plate of FIG. *7a* which is hardened steel faces on both sides of the valve and the valve of *7c* which has a bronze surface 100 and 100' on both sides of the valve plate can be used where it is desirable to have the valve plate reversible orientation option and without having to specially machine fishtails on both surfaces of the valve plate.

From the above description of the preferred embodiments of practicing the invention, it can be seen that the thin valve plate provides the primary advantages of greatly reducing the cost of manufacture of hydraulic unit valve plates and also providing reverse orientation of the valve plate within the housing while still maintaining optimum depth fishtails to significantly reduce hydraulic noise and cavitation damage. Furthermore, the thin valve plate permits greater leeway in forming the cross sectional shape of fishtail slots than previously obtainable. It is thus believed that the objects of the present invention are fully met by the preferred embodiments disclosed.

I claim:

1. A valve plate for a hydraulic unit comprising a housing having inlet and outlet ports therein, a cylinder block having cylinders therein and being rotatable relative to the housing, each of said cylinders having a cylinder port, said cylinder ports serially communicating with said inlet and outlet ports, pistons slidable in said cylinders, displacement setting means for reciprocating said pistons within said cylinders, and valve means positioned between said cylinder block and said inlet and outlet ports in said housing to selectively provide fluid communication between said housing ports and said cylinders in said cylinder block as said cylinder block rotates, said valve means including; a valve plate secured against rotation relative to said housing, said valve plate having a plurality of valve plate ports radially positioned so as to serially communicate with said cylinder ports, at least one of said valve plate ports having means at the leading edge thereof for increasing communication between the approaching cylinder ports and the associated one of said inlet and outlet ports, said means to increase communication including a slot extending through said valve plate, said valve plate having a thickness not substantially greater than 0.100 inch and less than the maximum width of said slot, and a housing portion abuts the side of said valve plate opposite said cylinder block to form the bottom of said slot.

2. The valve plate of claim 1 wherein said slot is of uniform width over a substantial length of said slot.

3. The valve plate of claim 1 wherein said cylinder block includes a bearing plate adjacent to and rotatable with respect to said valve plate, said valve plate being of a material harder than said bearing plate.

4. The valve plate of claim 1 wherein two adjacent valve plate ports have slots extending toward each other and said valve plate is reversible in its position relative to said housing.

5. The valve plate of claim 1 wherein said valve plate ports are provided with slots only in the leading position, and wherein said valve plate may be reversed in its position relative to that housing to facilitate operation of the hydraulic unit in an opposite direction.

6. The valve plate of claim 1 wherein thickness of the valve plate is not greater than approximately one-half of the effective width of said slot.

7. The valve plate of claim 1 wherein a portion of said slot width gradually increases as it approaches said valve plate port.

8. The valve plate of claim 3 wherein said slot has a key hole-shaped cross section.

9. The valve plate of claim 1 wherein said valve plate is hardened steel and having a surface facing said cylinder block of a material softer than the material of said cylinder block.

10. The valve plate of claim 9 wherein both surfaces of said valve plate are of a material softer than the material of said cylinder block and the valve plate is reversible in said housing.

11. The valve means of claim 1 wherein said valve plate includes securing means radially positioned relative to the axis of said rotating block at a distance greater than the radius of said cylinder block.

12. The valve means of Claim 11 wherein said valve plate has a generally circular periphery with tabs extending radially outwardly from the periphery of the valve plate, each of said tabs being provided with an opening extending through said valve plate, said housing having locating pins extending axially and aligning housing parts and positioned so as to engage said openings of the valve plate tabs to secure the valve plate against rotation relative to the housing.

13. The valve plate of claim 1 wherein said valve plate ports and said slots are stamped through said valve plate.

14. The valve plate of claim 13 wherein the thickness of the valve plate is equal to approximately one-half the effective width of said slot.

15. An improved valve plate for a rotary hydraulic unit including a housing having a central cavity for locating a cylinder block mounted for rotation about an axis extending through said housing, a portion of said housing having a planar surface perpendicular to said axis, said housing having an inlet port and an outlet port extending to said planar surface, said cylinder block having an end face parallel to said housing planar surface and with a plurality of cylinder ports at said cylinder end face in fluid communication with hydraulic working volumes in said cylinder block, a flat valve plate disposed between said housing planar surface and said cylinder block end face and being stationarily positioned relative to said housing, said valve plate having valve plate ports extending through said valve plate and in direct fluid communication with said housing inlet and outlet ports, said valve plate ports being in serial fluid communication with said cylinder ports as said cylinder block rotates, at least one of said valve plate ports having fluid communication means consisting of a slot extending annularly from said one of said valve plate ports, said slot having a radial dimension less than the radial dimension of said one of said valve plate ports and providing limited initial fluid communication between said one of said valve plate ports and said cylinder block ports upon rotation of said cylinder block, said valve plate improvement comprising said valve plate having a thickness not substantially greater than 0.100 inch and no greater than the width of said slot, said slot extending through said valve plate and forming a fluid communication passageway having a bottom formed by a said housing planar surface whereby said passageway has a depth no greater than the width of said passageway.

16. The valve plate of claim 14 wherein said valve plate ports and said slot are formed by stamping of said valve plate.

17. The valve plate of claim 15 wherein said valve plate being at least in part of hardened material and the surface of said valve plate adjacent said cylinder block end face is provided by a material softer than said cylinder block end face.

18. The valve plate of claim 15 wherein two of said valve plate ports are provided with slots permitting limited initial fluid communication and wherein said slots are asymmetrically positioned on said valve plate hereby said valve plate can be positioned in said housing in a first position for counterclockwise rotation of said cylinder block and positioned in said housing in an opposite position for clockwise rotation of said cylinder block.

19. The valve plate of claim 15 wherein said valve plate has radial indentions which engage stationary portions of said housing to locate said valve plate relative to said housing.

20. The valve plate of claim 15 wherein said valve plate is provided with two adjacent pairs of valve plate ports with each of said valve plate ports in said pair being provided with a slot permitting limited initial fluid communication and wherein said valve plate ports and said slots are symmetrically positioned on said valve plate and said valve plate is capable of being positioned in reverse orientation relative to said cylinder block and said housing planar surface.

21. The valve plate of claim 20 wherein both surfaces of said valve plate are formed of a material softer than said cylinder block end face.

22. The valve plate of claim 15 wherein at least a portion of said slot is tapered toward said valve plate ports.

23. The valve plate of claim 22 wherein the portion of said valve plate slot furthest located from narrowest portion of said tapered portion of said valve said valve plate port has a greater width than the plate slot and wherein an intermediate between said greater width portion and said tapered portion forms a venturi.

24. The valve plate of claim 23 wherein the depth of said slot is no greater than half of the area of said slot divided by the length of said slot.

* * * * *